US005340085A

United States Patent [19]

Keibler

[11] Patent Number: 5,340,085

[45] Date of Patent: Aug. 23, 1994

[54] LOG LIFTING AND SUPPORTING DEVICE

[76] Inventor: Howard M. Keibler, R.D. #2, Box 133-A, Saltsburg, Pa. 15681

[21] Appl. No.: 957,717

[22] Filed: Oct. 7, 1992

[51] Int. Cl.[5] ..... B66D 1/00; B66D 5/02

[52] U.S. Cl. ..... 254/266; 254/375

[58] Field of Search ..... 254/376, 264, 375, 223, 254/324, DIG. 1, 266; 294/82.11, 82.14, 81, 55

[56] References Cited

U.S. PATENT DOCUMENTS

| | | | |
|---|---|---|---|
| 36,887 | 11/1862 | Arnold | 254/223 X |
| 87,871 | 3/1869 | Oliver et al. . | |
| 218,598 | 8/1879 | Thayer . | |
| 287,002 | 10/1883 | Cornelieus . | |
| 513,993 | 2/1894 | Eustice | 254/223 X |
| 539,328 | 5/1895 | Anthony . | |
| 772,994 | 10/1904 | Wood . | |
| 932,444 | 8/1909 | Chambers | 254/223 |
| 1,229,853 | 6/1917 | Adams et al. | 254/223 X |
| 1,553,609 | 9/1925 | Grau | 254/223 X |
| 2,276,127 | 3/1942 | Wahl | 254/376 X |
| 2,381,531 | 8/1945 | Ehmann | 294/82.14 |
| 2,492,597 | 12/1949 | Schnadt . | |
| 2,867,026 | 1/1959 | Gale | 294/82.14 |
| 4,030,705 | 6/1977 | Bontrager | 254/264 |
| 4,304,394 | 12/1981 | O'Hara . | |
| 4,597,562 | 7/1986 | Joyce . | |

*Primary Examiner*—Daniel P. Stodola
*Assistant Examiner*—Michael R. Mansen
*Attorney, Agent, or Firm*—Ronald S. Lombard

[57] ABSTRACT

A collapsible, portable, one person log lifting and supporting device is disclosed for use as a saw-aide to raise and support one end of the log for ease in sawing the log. The device includes an inverted substantially U-shaped frame, sized to encompass the diameter of a log to be sawed. The removable stabilizer bars are provided for stability for the frame when raising and supporting one end of the log to be sawed. A reel is included which is operably attached to one end of the cable and when operated raises and lowers the log to be sawed.

15 Claims, 10 Drawing Sheets

LOG LIFTING AND SUPPORTING DEVICE

BACKGROUND OF THE INVENTION

The present invention relates to a log lifting and supporting device and, in particular, to a log lifting and supporting device for use as a sawing aid to raise and support one end of a log for ease in sawing. The advantages of raising logs for sawing are well known. For example, when using a chain saw by raising the log, it prevents the chain saw bar, tip, sprocket and chain from striking foreign objects possibly resulting in flying debris, kickbacks and damage to chain, bar and sprocket. Raising the log also prevents binding or pinching of the chain saw bar which may result in dangerous kickback, and possible damage to the bar, sprocket and chain.

In U.S. Pat. No. 4,304,394, issued to Harold N. O'-Hara, is described a log lifting device which includes an upstanding post with an attached flexible strand- The flexible strand, such as a chain, releasably connects the post to a jack. Another log lifting device is described in U.S. Pat. No. 2,492,597 issued to Elmer Schnadt. The Schnadt patent discloses a log lifting apparatus including a sling for a log, an upstanding sling attaching member at each side of the log. One of the attaching members includes vertically spaced anchoring means for selectively anchoring engagement of one end of the sling thereto. Quick releasing anchoring means is carried by the other of the attaching members tot the other end of the sling and jacking means is included for the other of the attaching members.

Problems may be encountered with these prior art devices as far as stability and ease of use.

SUMMARY OF THE INVENTION

The present invention overcomes the difficulties of the prior art and provides a collapsible, portable, one person log lifting and supporting device for use as a sawing-aid to raise and support one end of a log for ease in sawing the log.

The log lifting and supporting device of the present invention includes an inverted substantially U-shaped frame. The frame consists of a central horizontal cross member and a vertical support including a first vertical support member affixed at the upper end thereof perpendicularly to one end of the cross member and a second vertical support member affixed at the upper end thereof perpendicular to the other end of the cross member. The frame is sized to encompass the diameter of a log to be sawed.

A removable stabilizer bar means is included for providing stability for the frame when raising and supporting one end of a log to be sawed. The removable horizontal stabilizer bar means preferably comprises a pair of stabilizer bars. Stabilizer bracket means is included for receiving the stabilizer bars. The stabilizer bracket means are affixed to the first vertical support member proximate the lower end thereof and to the second vertical support member proximate the lower end thereof.

Cable means is included for lifting and supporting the log to be sawed. In conjunction with the cable means, a reel means is included which is affixed to the central horizontal cross member and operably attached to one end of the cable means so that the reel when operated lowers and raises the log to be sawed suspended by the cable.

Each of the removable stabilizer bars is slidable within the stabilizer bracket. During lifting of a log each of the stabilizer bars are positioned perpendicular to the vertical support members and substantially intersected thereby. The horizontal stabilizer bars position transversely to the central horizontal cross member.

Preferably, the horizontal cross member has a cable guide aperture passing therethrough proximate a point equidistant from the first vertical support member and the second vertical support member. The cable guide aperture is included for enhancing the stability of the device by guiding the cable in a vertical direction parallel to the first vertical support member and the second vertical support member. The device also desirably includes a tubular cable guide affixed to the horizontal cross member within the cable guide aperture.

The reel desirably includes a cable drum, a drive sprocket operably affixed to the cable drum, a drum yoke for supporting the cable drum and the drive sprocket. The reel also includes a spring-loaded pin for engaging and disengaging the drive sprocket and operably supported by the drum yoke whereby the log may be raised and lowered in a controlled manner.

The reel desirably further includes a removable drive sprocket handle for engaging the drive sprocket and providing greater leverage when raising or lowering the log to be sawed.

The cable means preferably includes a cable, a choke grip means for causing the cable to tighten around the log as the log is raised whereby the log is firmly gripped by the cable when the log is raised. Preferably, the choke grip includes a hook means for engaging the cable. The hook means desirably includes a sliding choker hook comprising a hook having a hollow sleeve section passing therethrough at one end thereof. The cable means at the other end thereof preferably has a loop therein for engaging the hook when raising the log.

A log cradle is desirably included for cradling the log during sawing for increased stability. Also a retriever and puller is included for providing ease in retrieving tile cable by grabbing the cable and pulling it under the log to be sawed.

Preferably the stabilizer bar means further includes a first stop affixed to each of the stabilizer bars. The first stop is for stopping each of the stabilizer bars at a predetermined point such that one of the stabilizer bars is intersected by the first vertical support member and the other of the vertical stabilizer bars is intersected by the second vertical support member. Preferably, the stabilizer bar means further includes a second stop affixed to each of the stabilizer bars. The second stop is for permitting insertion of the stabilizer bars into the stabilizer bar brackets in only one direction to assure the first stop will be in proper position.

Preferably, each of the stabilizer bars is a predetermined minimum length such that ratio of the length of the first stabilizer bar to the length of the first vertical support member is at least 0.8 and such that the ratio of the length of the second stabilizer bar to the length of the second vertical support member is at least 0.8, whereby the first and second stabilizer bars are sized to give adequate stability to the device.

BRIEF DESCRIPTION OF THE DRAWINGS

For a better understanding of the present invention, reference may be had to the accompanying drawings, which.

BRIEF DESCRIPTION OF THE PREFERRED EMBODIMENTS

Figure 1:
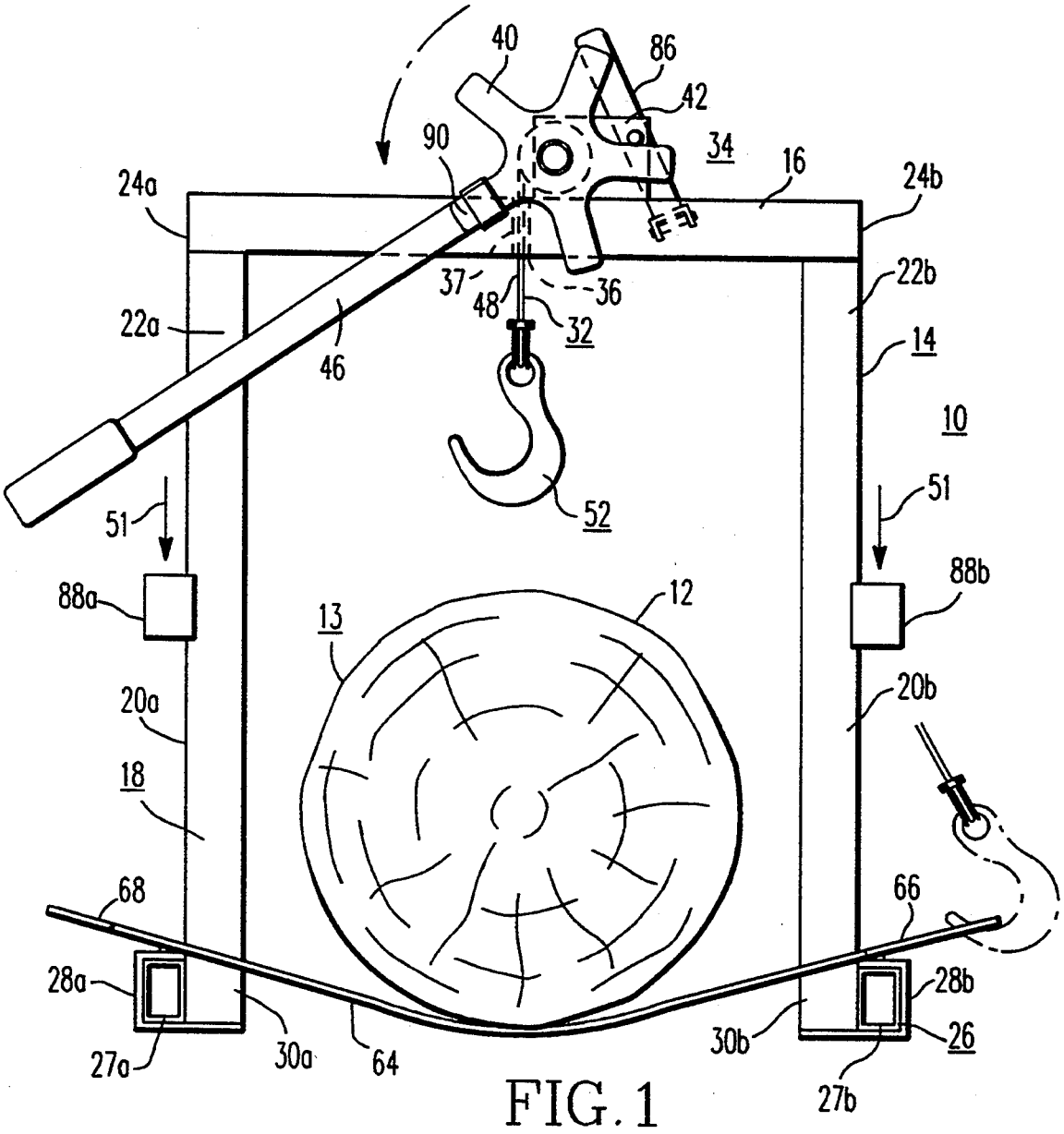
FIG. 1 is a front elevational view of the log lifting and supporting device of the present invention.

With reference to FIG. 1, there is shown a collapsible, portable, one person log lifting and supporting device 10 for use as a sawing-aid to raise and support one end 12 of a log 13 for ease in sawing said log. The log lifting and supporting device 10 includes an inverted, substantially U-shaped frame 14. The frame consists of a central horizontal cross member 16, a first vertical support member 20*a* affixed at the upper end thereof 22*a* perpendicularly to one end 24*a* of the cross member 16. The second vertical support member 20*b* is affixed at the upper end 22*b* thereof perpendicularly to the other end 24*b* of the cross member 16. The frame 14 is sized to encompass the diameter of the log 13 to be sawed, as shown in FIG. 1 for example.

Figure 2:
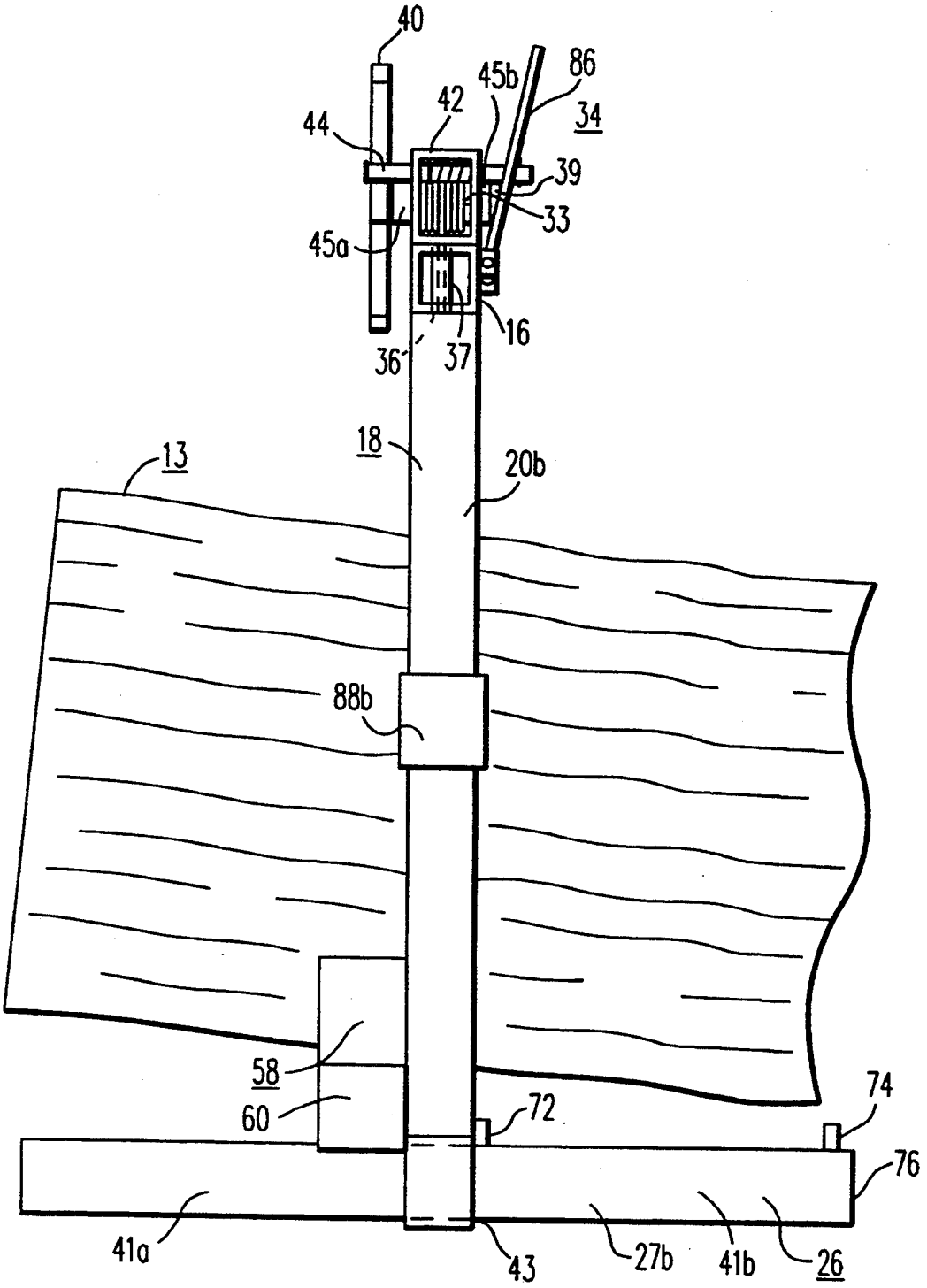
FIG. 2 is a side elevational view of the lifting and supporting device.
Figure 3:
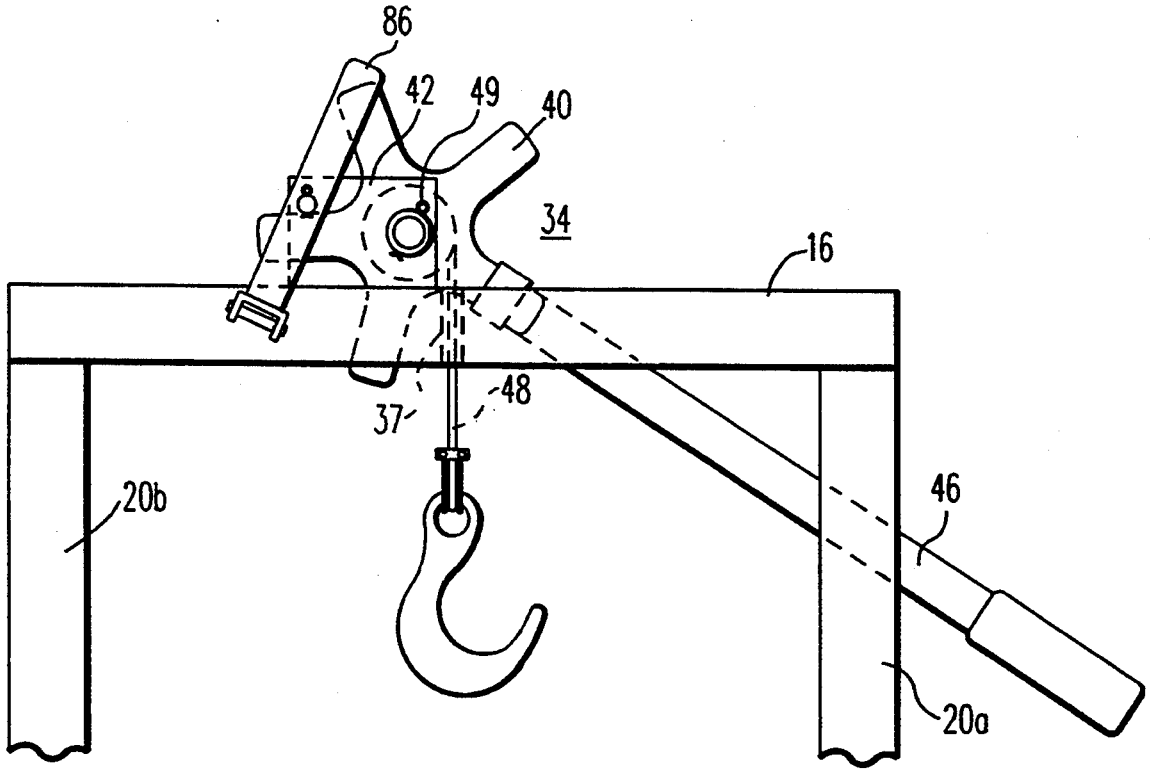
FIG. 3 is a rear elevational view of the upper portion of the log lifting and supporting device.

Removable horizontal stabilizer bar means 26 such as shown in FIGS. 1 and 2 are included for providing stability for the frame 14 when raising and supporting one end 12 of the log 13 to be sawed. Stabilizer brackets 28*a*, 28*b* are provided for receiving the stabilizer bar means 26. The stabilizer brackets 28*a*, 28*b* are affixed, respectively, to the first vertical support member 20*a* at the lower end 30*a* of the first vertical support 20*a* and the lower end 30*b* of the second vertical support 20*b*.

The cable 32 is included for lifting and supporting the log to be sawed- The cable may be braided steel cable for example- A reel 34 is included and is affixed to the central cross member 16 and is operably attached to one end 33 of the cable 32 so that the reel 34 when operated lowers and raises the log 13 to be sawed. The removable stabilizer bar 26 consists of a pair of stabilizer bars 27*a*, 27*b*. Each of the stabilizer bars 27*a*, 27*b* is slidable within the respective stabilizer bracket 28*a*, 28*b* and is positioned perpendicular to the vertical support 18 and is substantially intersected thereby, as shown in FIG. 2, to form a pair of feet 41*a*, 41*b*. Each of the horizontal stabilizer bars 27*a*, 27*b* is positioned transversely to the central horizontal cross member 16.

It has been found that each of the stabilizer bars 27*a*, 27*b* should be a predetermined minimum length such that the ratio of the length of the first of the stabilizer bars 27*a* to the length of the first vertical support 20*a*, is at least 0.8 to 1.0 and such that the ratio of the second stabilizer bars 27*b* to the length of the second vertical support 20*b* is at least 0.8, whereby the first and second stabilizer bars 27*a*, 27*b* are sized to give adequate stability for the device 10 when raising a log 13.

The horizontal cross member 16 preferably has a cable guide aperture 36 passing therethrough and positioned equidistant from the first vertical support 20*a*, and the second vertical support 20*b*. The cable guide aperture 36 is for enhancing the stability of the device by guiding the cable in a vertical direction parallel to the first vertical support 20*a* and the second vertical support 20*b*. Preferably, the device 10 further includes a tubular cable guide 37 which is affixed to the central horizontal cross member 16 within the cable guide aperture 36.

Figure 7:
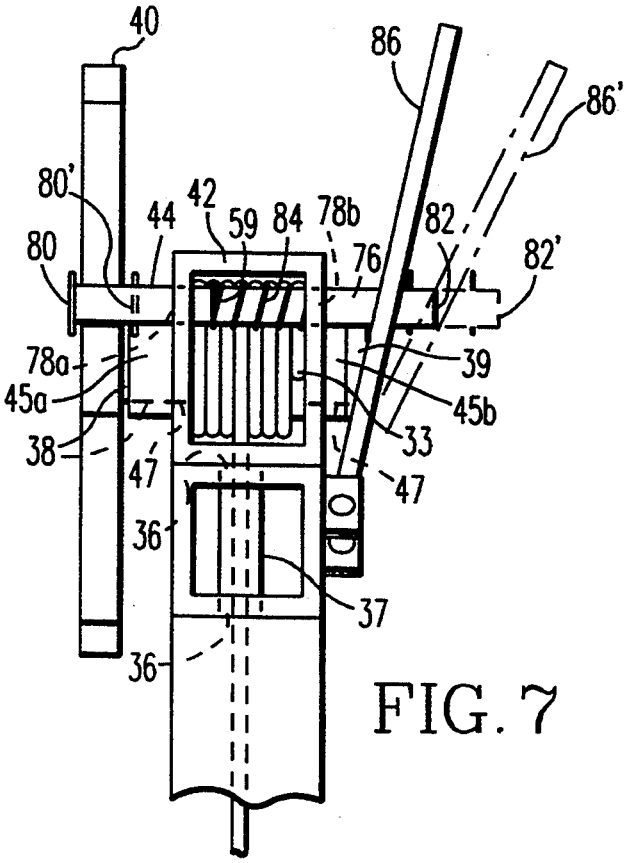
FIG. 7 is a side elevational view of sprocket engagement pin means.
Figure 8:
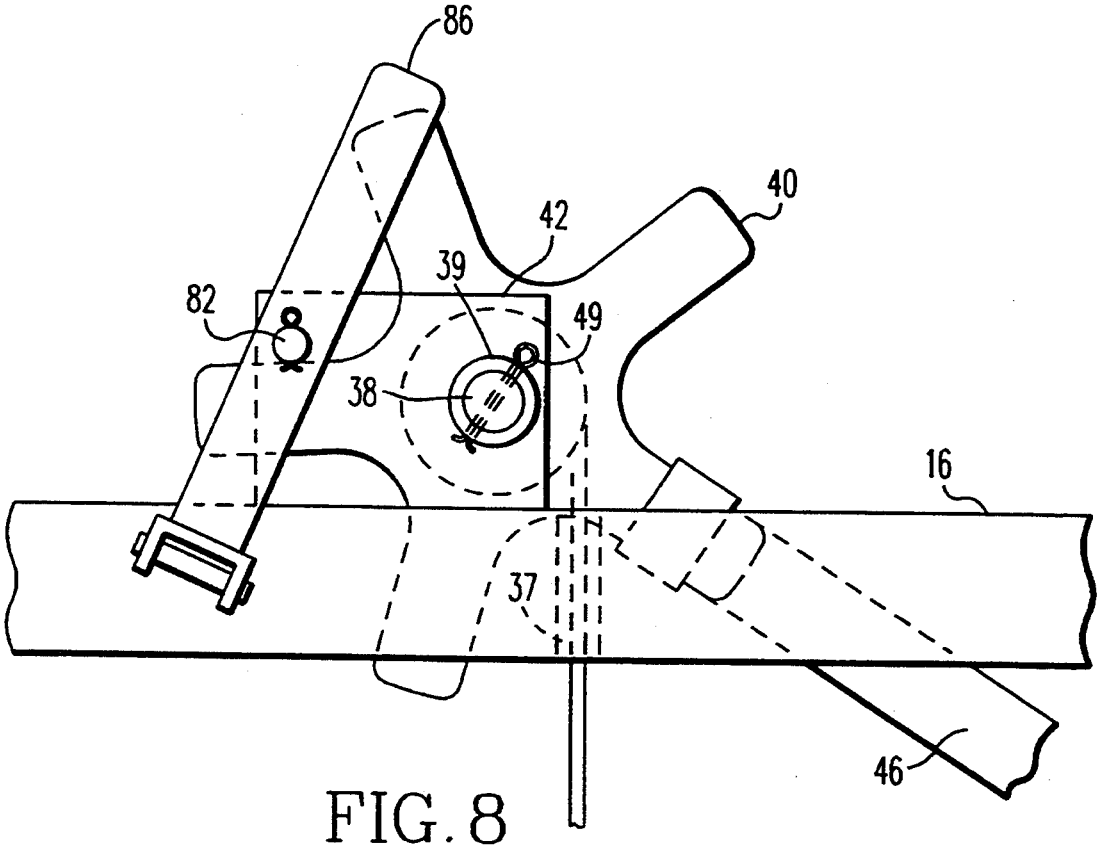
FIG. 8 is a rear elevational view of the sprocket engagement pin means.

The reel 34 preferably includes a cable drum 38, as shown in FIGS. 2 and 7. The drive sprocket 40 is operably affixed to the cable drum 38. A drum yoke 42 is provided for supporting the cable drum 38 and the drive sprocket 40. Cable drum bearings 45*a*, 45*b* are affixed to yoke 42 over first apertures 47. Cable drum 38 passes through drum bearings 45*a*, 45*b*. Cotter key 49 passes through bushing 39 and drum 38 to hold drum 38 in place. The drum yoke 42 is affixed to cross member 16 as shown in FIGS. 1 and 2.

The sprocket engagement pin means 44 includes a spring loaded pin 76 as shown in FIG. 7. The cable drum 38 has first and second apertures 78*a*, 78*b* passing therethrough in predetermined position as shown in FIG. 7. Pin 76 is slidably supported by the drum yoke 42 with one end 80 of pin 76 passing through the first aperture 78*a* and the other end 82 of pin 76 passing through the second aperture 78*b*. Pin 76 passes through spring 84 as shown in FIG. 7. Spring retaining bushing 59 is affixed to pin 76.

Preferably the sprocket engagement pin means 44 further includes movable handle means 86 in operable relationship with the spring loaded pin 76 to move the pin 76 into and out of engagement with the drive sprocket 40, to prevent or permit rotation of the drive sprocket 40.

A sprocket engagement pin 44 is provided for engaging and disengaging the drive sprocket 40 to prevent or permit rotation of drive sprocket 40 as desired. The sprocket engagement 44 is supported by the drum yoke 42, whereby the log 13 may be raised and lowered in a controlled manner.

The reel 34 preferably further includes a removable drive sprocket handle 46 for engaging the drive sprocket 40 and providing greater leverage when raising or lowering the log 13 to be sawed.

Figure 4:
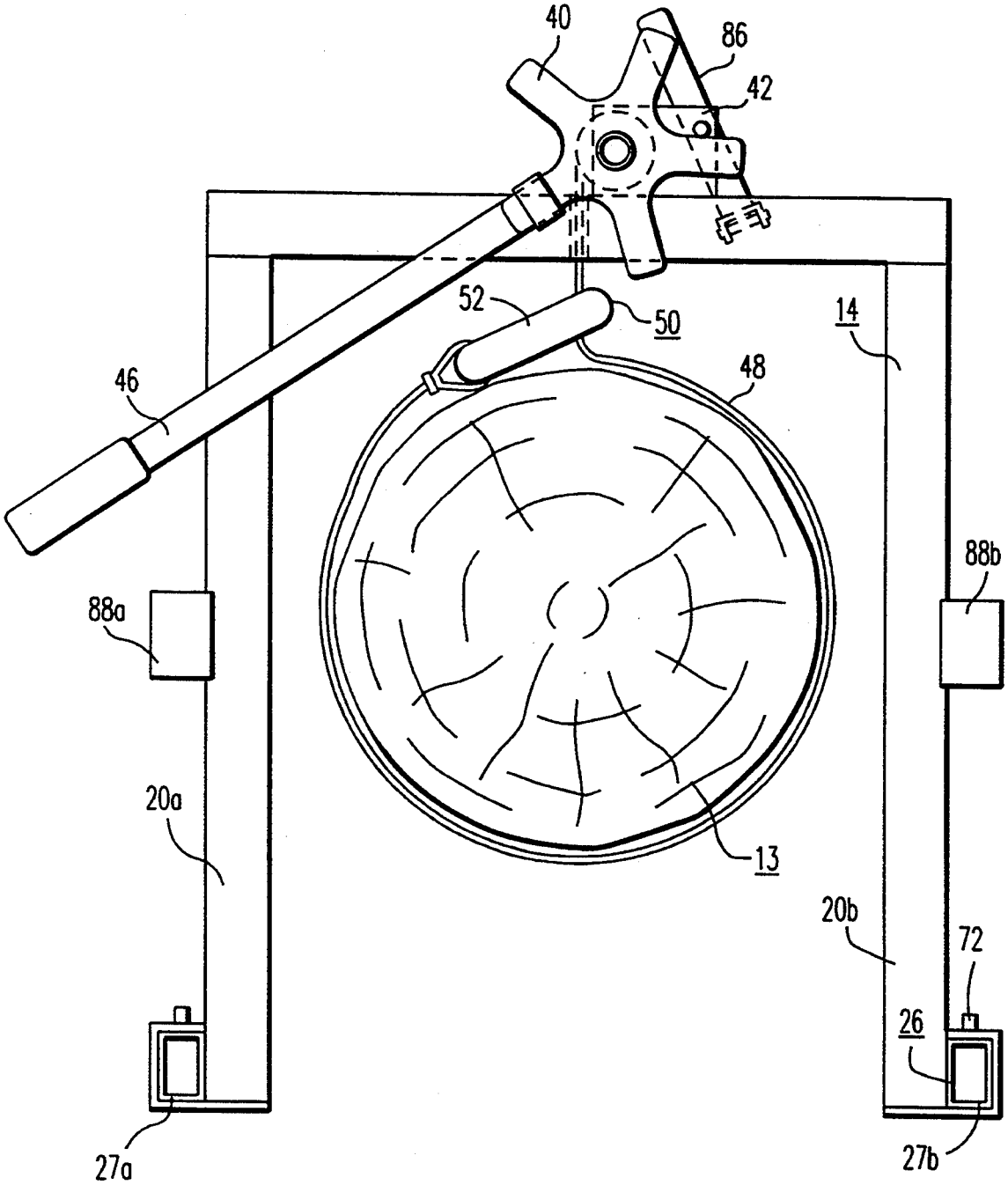
FIG. 4 is a front elevational view of the log lifting and supporting device showing a log in a raised position.
Figure 5:
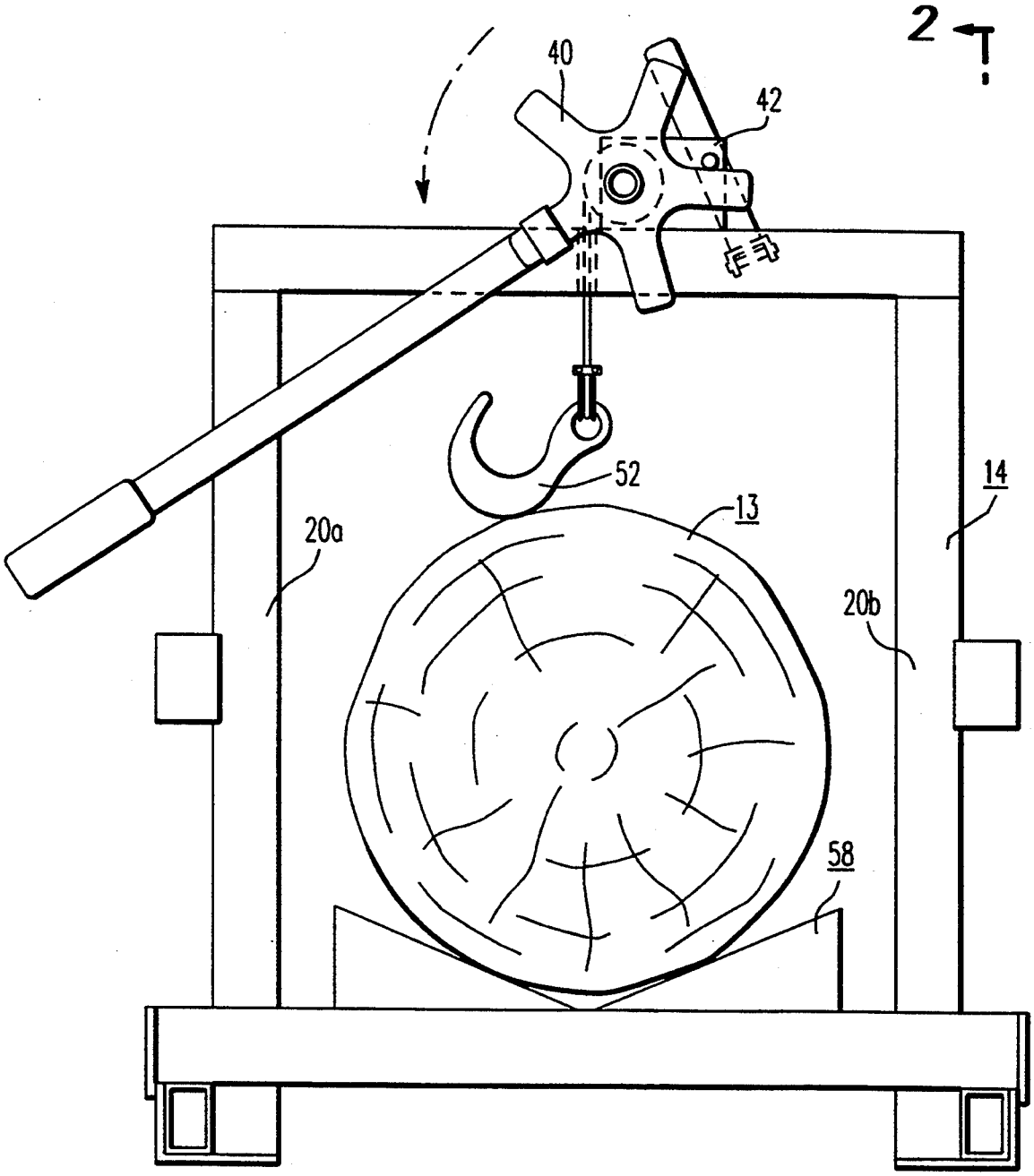
FIG. 5 is a front elevational view showing a log in the lowered position resting on the log cradle of the present invention.
Figure 9:
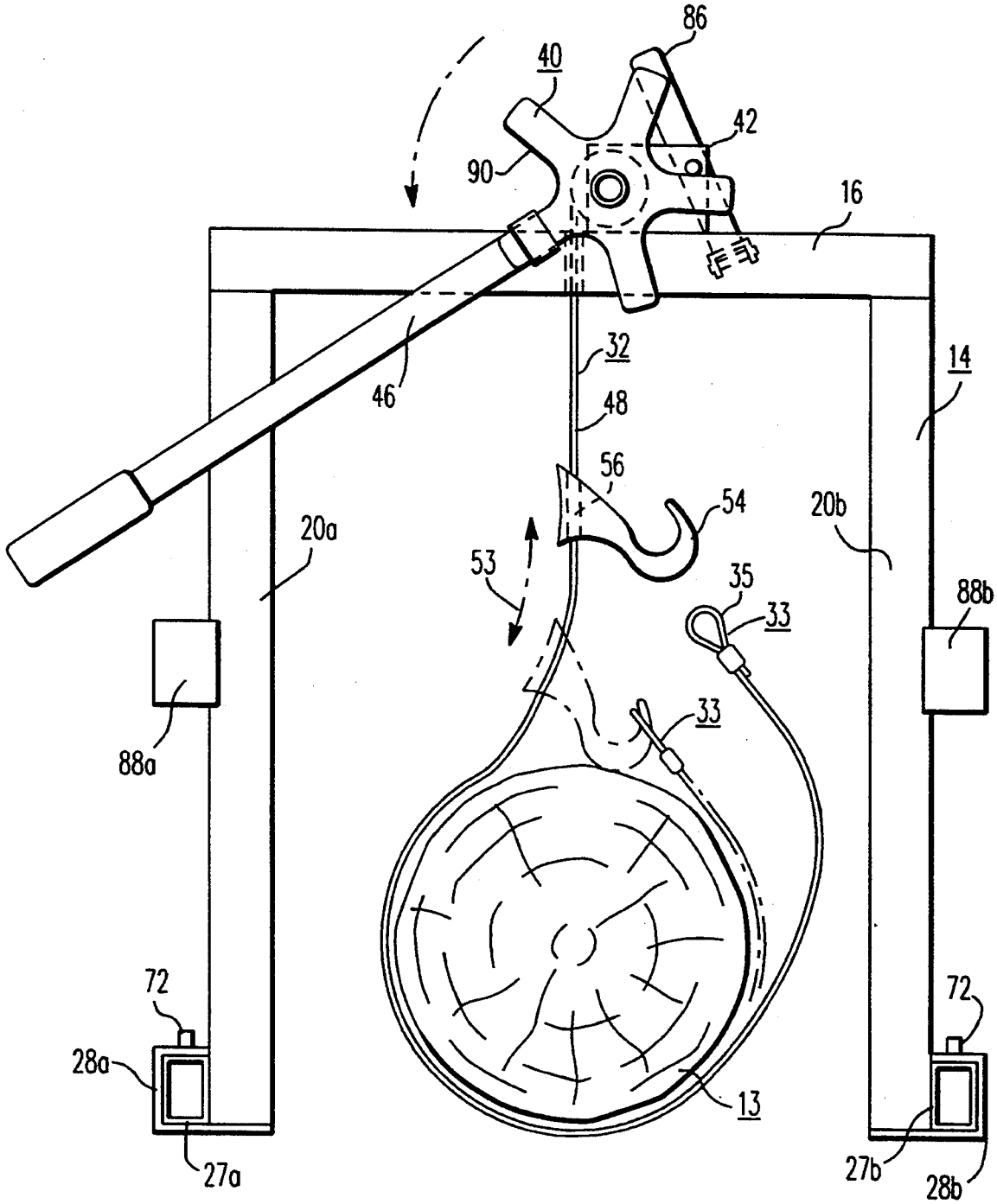
FIG. 9 is a front elevational view of the device showing the operation of the sliding choker hook when engaging a log.
Figure 10:
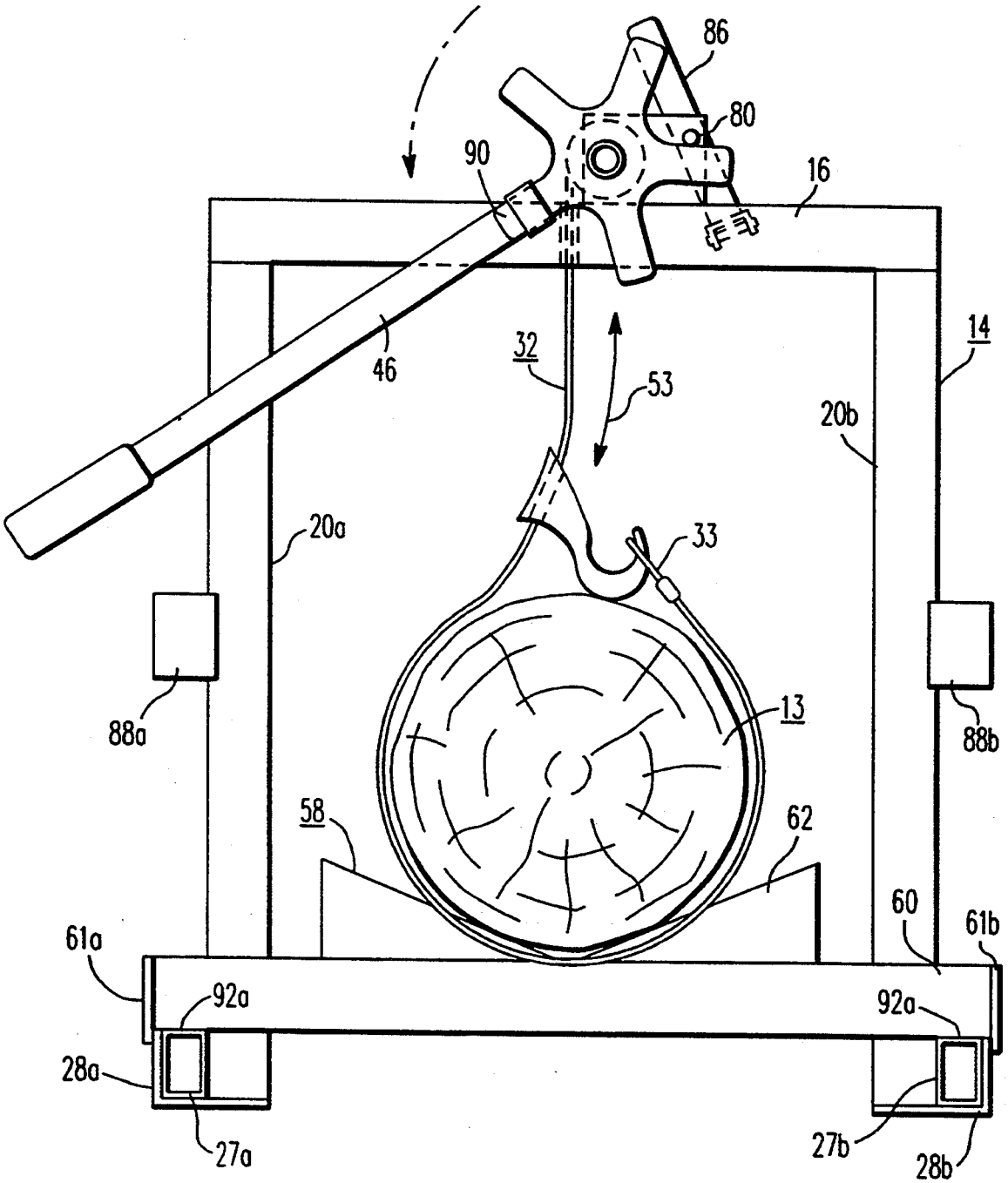
FIG. 10 is a front elevational view of the device showing the log in a lowered position on the cradle.
Figure 11:
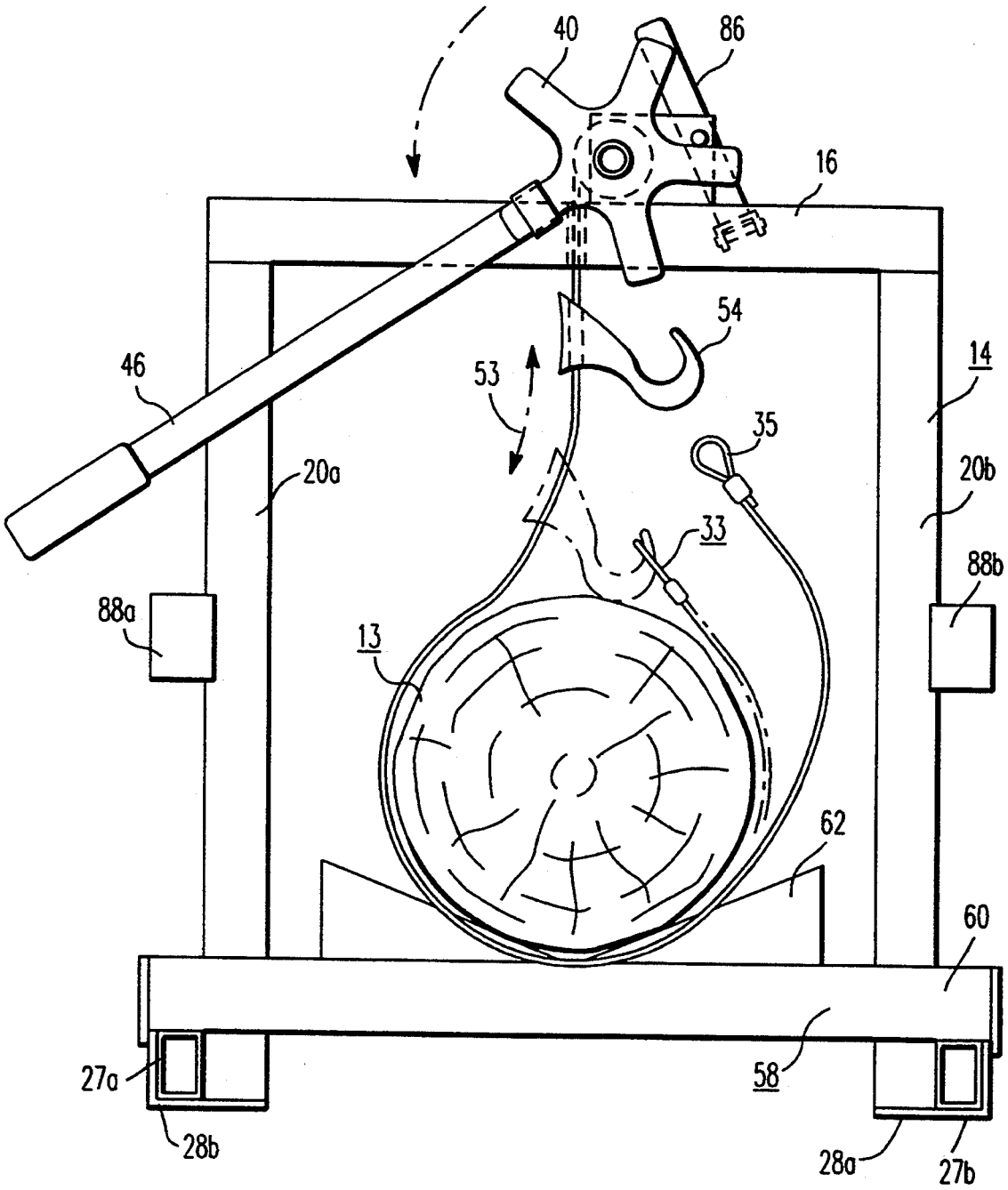
FIG. 11 is a front elevational view of the device showing the unhooking of the cable after the log rests on the cradle.

The cable means 32 of the present invention preferably comprises a cable 38 and choke grip means 50 for causing the cable to tighten around the log 13 as the log is raised whereby the log is firmly gripped by the cable 48 when the log is raised, as shown in FIG. 4. The choke grip means 50 preferably comprises a hook means 52, which may be a standard hook as shown in FIG. 1, which is pulled around the log 13 and then engages cable 48. Preferably, the hook means 52 comprises a sliding choker hook 54 as shown in FIGS. 9–11, where the arrows 53 indicate the direction of travel for the choker hook 54. The sliding choker hook 54 has a hollow sleeve section 56 passing therethrough as shown in FIG. 9. Such a sliding choker hook 54 is distributed by Indusco, 120 West Hamburger Street, Baltimore, Md. 21230. Preferably, the cable means 32 at the other end 33 thereof has a loop 35 therein for engaging the sliding choker hook 54 when raising a log 13 such as shown in FIGS. 9, 10 and 11.

A log cradle 58 such as shown in FIGS. 10 and 11 is included for cradling the log during sawing for increased stability. The log cradle 58 has a bottom portion 60 sized to rest on the stabilizer bars 27*a*, 27*b*. End members 61*a*, 61*b* prevent the cradle 58 from sliding transversely on the stabilizer bars 27*a*, 27*b*. The log cradle 58 also includes a V-shaped cradle portion 62 for contact with the log 13 to be sawed.

Figure 6:
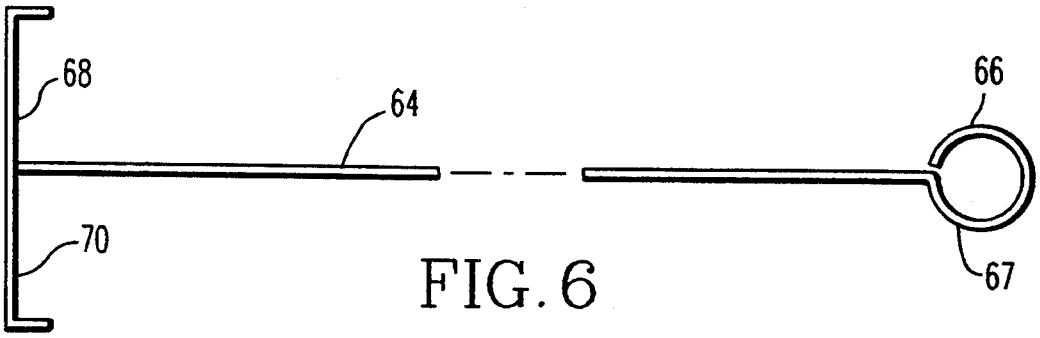
FIG. 6 is a plan view of the cable retriever and puller of the present invention.
Figure 13:
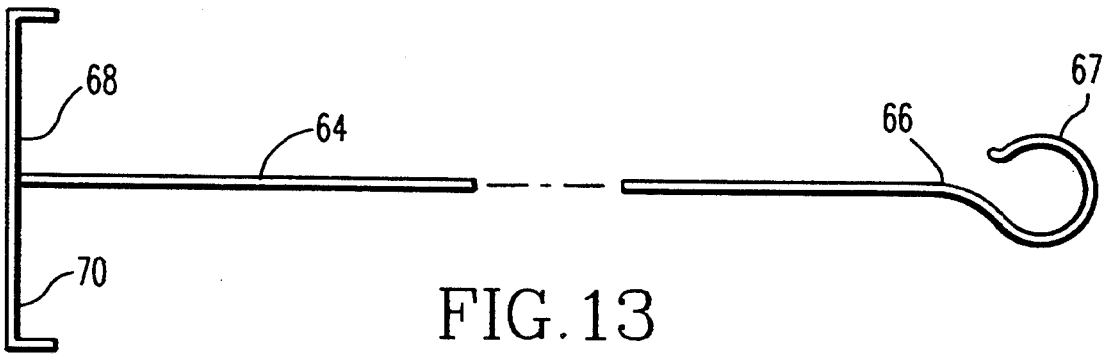
FIG. 13 is a plan view of a modified form of the cable retriever and puller for use with the sliding choker hook of the present invention.

A cable retriever and puller 64, as shown in FIGS. 6 and 13 , is provided for ease in retrieving the cable by pulling the cable under the log to be sawed. The cable retriever and puller 64 shown in FIG. 6 is adapted at one end 66 thereof for engagement with the hook 52 as shown in FIG. 1. The cable retriever puller 64 shown in FIG. 13 is adapted at the one end 66 for engagement with the loop 33 of the cable 32 and includes grappling portion 67. The other end 68 of the cable retriever and puller 64 includes a handle portion 70. The cable retriever and puller 64 is bowed as shown in FIG. 1 for ease in sliding it under a log.

With reference to FIG. 2 , preferably the horizontal stabilizer bar 26 includes first stop 72 affixed to each of the stabilizer bars 27*a*, 27*b* The first stop 72 is for stopping the stabilizer bars 27*a*, 27*b* at a predetermined point 43 such that one of the stabilizer bars 27*a* is intersected by the first support 20*a* and the other of the stabilizer bars 27*b* is intersected by the second vertical support member 20*b* to form feet 41*a*, 41*b*. Preferably, each of the stabilizer bars 27*a*, 27*b* further comprise a second stop 74 affixed to each of the stabilizer bars 27*a*, 27*b* proximate one end 76 thereof. The second stop 74 is for permitting insertion of each of said stabilizer bars 27*a*, 27*b* into the stabilizer bar brackets 28*a*, 28*b* in only one direction to ensure the first stop 72 will be in proper position.

The present invention provides one person the ability to manually raise and cradle a log in a direct vertical motion without seriously altering the center of gravity of the load. The device 10 of the present invention can raise a log 13 that cannot be rolled. Such as a log still partially attached to a stump or with limbs still attached, bowed or curved. While employing the choke grip 50 of the present invention, there is no yanking or jerking required to make the lift. Once the log is cradled in cradle 58 it cannot roll off. The device 10 permits total control of the lift. The working capacities of the device 10 for example with 1000 pound working load would require using a cable 48 of 4200 pound minimum breaking strength. The frame 14 may be sized for any diameter log, typically 1 to 20 inch diameter logs are often encountered by a person collecting firewood, for example. Preferably, the construction of the device 10 is tubular carbon steel with plastic ribs and end caps. The device 10 as shown in FIGS. 1–12 is for right-handed operation i.e. using the right hand to grasp handle 46. The device 10 is convertible for left-handed operation by switching sprocket 40 and sprocket engagement pin 44 to be mounted in a reverse manner from that shown in FIG. 7, for example- The device 10 is easily assembled and disassembled for storage and transportation- U-shaped stabilizer bar storage brackets 88*a*, 88*b* are affixed to the first and second vertical support members 20*a*, 20*b* as shown in FIG. 1 may be utilized for storage of the stabilizer bars 27*a*, 27*b* by sliding the bars in the direction of the arrows 51 in FIG. 1. The stabilizer bar brackets 88*a*, 88*b* are sized so that the stabilizer bars 27*a*, 27*b* form a snug fit with the brackets for transporting the device. Additionally, the cradle 58 and the drive sprocket handle 46 may also be mounted to the frame for transporting.

Utilizing the device 10 a 30 pound effort is all the is required to lift a 1000 pound load for example. The device 10 may be made of tubular stock. The device 10 is lightweight, weighing about 40 pounds for example, making it easy to transport.

To operate the device 10, the stabilizer bars 27*a*, 27*b* are slid through stabilizer brackets 28*a*, 28*b* to the center position, i.e., where the first stop 72 contacts the vertical support 18. The frame 14 is placed over the log 13. The pin 76 is retracted to permit free spooling of the drive sprocket 40 and the cable drum 38. Enough cable 48 is spooled out for the hook 52 to reach around the log 13. The cable retriever and puller 64 is slid under the log to retrieve the hook 52 or loop 33 whichever configuration is used. If the sliding choker hook 54 is utilized the retriever 64 shown in FIG. 13 is used to retrieve the loop at the other end of the cable 33 shown in FIG. 9. The sliding choker hook 54 is then inserted through the loop 33 to form a choke grip on the log. The cable 48 is then drawn snug by retracting the pin 76 and turning the drive sprocket 40 by hand. When the cable is snug, release the pin 76 through the drive sprocket teeth 90 to prevent free spooling of the cable 48. The removable drive sprocket handle 46 is then placed over a tooth 90 of the drive sprocket 40 and the log is lifted while retracting the locking pin. When the handle 46 is raised, release the pin 76 and remove the handle 46. This is repeated until the log is approximately 6 inches off the ground. The log cradle 58 is then placed across the tops 92*a*, 92*b* of the stabilizer bars 27*a*, 27*b* as shown in FIG. 10 parallel with the horizontal cross member 16, the log is then lowered in a reverse manner as described for raising the log until the log 13 rests in the cradle 58.

Figure 12:
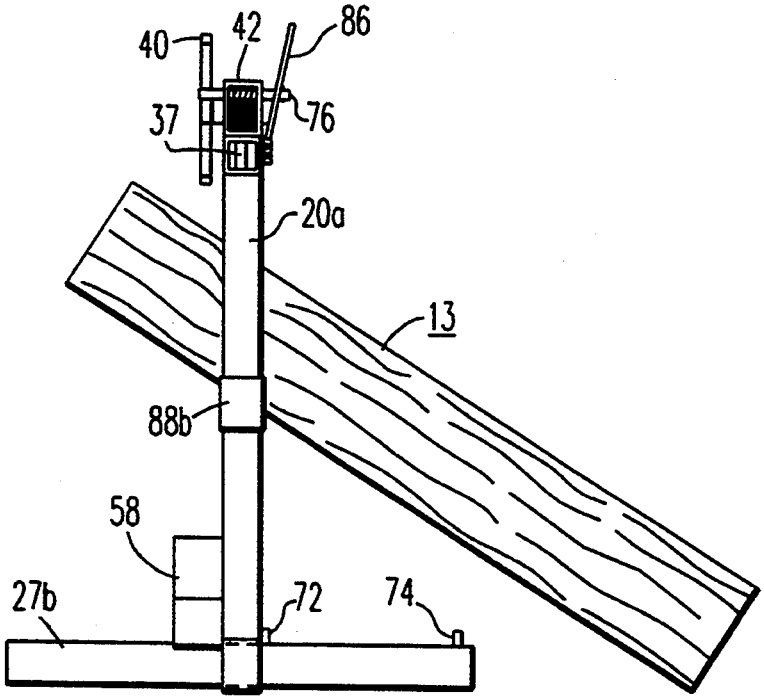
FIG. 12 is a side elevational view not to scale showing the relationship of the device to the log being raised.

As shown in FIG. 12, the device 10 in effect, forms a tripod with the log 13 which produces an inherent stability for the device 10 while the log is raised. When the log is lowered into the cradle 58, it is now ready for sawing.

By centering the cable within the cable guide aperture 36, it has been found that this diminishes the tendency of the log to roll or twist the frame 14 and provides a direct lift for the log.

The load capacity of the device can be changed by increasing the size of the cable.

I claim:

1. A collapsible portable one person log lifting and supporting device for use as a sawing aid to raise and support one end of a log for ease in sawing said log, said log lifting and supporting device comprising:

an inverted substantially U-shaped frame, said frame consisting of a central horizontal cross member, a first vertical support member affixed at the upper end thereof perpendicularly to one end of said horizontal cross member and a second vertical support member affixed at the upper end thereof perpendicularly to the other end of said horizontal cross member, said frame sized to compass the diameter of a log to be sawed;

removable horizontal stabilizer bar means for providing stability for said frame when raising and supporting one end of a log to be sawed, stabilizer bracket means for receiving said stabilizer bar means, said stabilizer bracket means affixed to said first vertical support member proximate the lower end thereof, and to said second vertical support member proximate the lower end thereof, said horizontal stabilizer bar means consisting of a pair of horizontal stabilizer bars, each of said horizontal bars is slidable within said stabilizer bracket means, one of said stabilizer bars positioned perpendicular to said first vertical support member and substantially intersected thereby and the other of said stabilizer bars positioned perpendicular to said second vertical support member and substantially intersected thereby, each of said horizontal stabilizer bars positioned transversely to said central horizontal cross member;

cable means for lifting and supporting said log to be sawed;

reel means affixed to said central horizontal cross member and operably attached to one end of said cable means so that said reel means when operated, lowers and raises said log to be sawed suspended by said cable means.

2. The log lifting and supporting device of claim 1, wherein said horizontal cross member has a cable guide aperture means passing therethrough, said aperture means positioned equidistant from said first vertical support member and said second vertical support member, said cable guide aperture means for enhancing the stability of said device by guiding said cable in a vertical direction parallel to said first vertical support member and said second vertical support member.

3. The log lifting and supporting device of claim 1, wherein said reel means comprises a cable drum, a drive sprocket operably affixed to said cable drum, a drum yoke means for supporting said cable drum and said drive sprocket, sprocket engagement pin means for engaging and disengaging said drive sprocket means and operably supported by said drum yoke means, whereby said log may be raised and lowered in a controlled manner.

4. The log lifting and supporting device of claim 3, wherein said sprocket engagement pin means comprises a spring loaded pin, said drum yoke having first and second apertures passing therethrough in predetermined position, said pin slidably supported by said cable drum with one end of said pin passing through said first aperture and the other end of said pin passing through said second aperture, a spring housed within said drum yoke, said pin passing through and in operable relationship with said spring.

5. The log lifting and supporting device of claim 4, wherein said sprocket engagement pin means further comprises moveable handle means in operable relationship with said spring loaded pin to move said pin into and out of engagement with said drive sprocket.

6. The log lifting and supporting device of claim 1, wherein said reel means further comprises removable drive sprocket handle means for engaging said drive sprocket and providing greater leverage when raising or lowering said log to be sawed.

7. The log lifting and supporting device of claim 1, wherein said cable means comprises a cable, choke grip means for causing said cable to tighten around said log as said log is raised, whereby said log is firmly gripped by said cable when said log is raised.

8. The log lifting and supporting device of claim 7, wherein said choke grip means comprises a hook means for engaging said cable.

9. The log lifting and supporting device of claim 8, wherein said hook means comprises a sliding choker hook having a hollow sleeve section, passing therethrough at one end thereof, said cable means at the other end thereof having a loop therein for engaging said sliding choker hook when raising said log.

10. The log lifting and supporting device of claim 1, further comprising log cradle means for cradling said log during sawing for increased stability.

11. The log lifting and supporting device of claim 1, wherein said horizontal stabilizer bar means further comprise first stop means affixed to each of said stabilizer bars, said first stop means for stopping said stabilizer bar, at a point such that said first stabilizer bar is intersected by said first vertical support member and the other of said stabilizer bars is intersected by said second vertical support member.

12. The log lifting and supporting device of claim 11, wherein each of said stabilizer bars further comprises second stop means affixed to each of said stabilizer bars, proximate one end thereof, said second stop means for permitting insertion of each of said stabilizer bars into said stabilizer bar brackets in only one direction to ensure the first stop means will be in proper position.

13. The log lifting and supporting device of claim 1, wherein each of said stabilizer bars is a predetermined minimum length such that the ratio of the length of a first of said stabilizer bars to the length of said first vertical support member is at least 0.8 and such that the ratio of the length of a second of said stabilizer bars to the length of said second vertical support member is at least 0.8, whereby said first and second stabilizer bars are sized to give adequate stability for said device.

14. The log lifting and supporting device of claim 1, further comprising a tubular cable guide, said tubular cable guide affixed to said central horizontal cross member within said cable guide aperture.

15. The log lifting and supporting device of claim 1, further comprising stabilizer bar storage bracket means for storing said stabilizer bars, said stabilizer bar storage bracket means affixed to said first vertical support member and said second vertical support member.

* * * * *